US009158218B2

(12) United States Patent
Tsujihiro et al.

(10) Patent No.: US 9,158,218 B2
(45) Date of Patent: Oct. 13, 2015

(54) ELECTROSTATIC LATENT IMAGE DEVELOPING TONER

(71) Applicant: KYOCERA DOCUMENT SOLUTIONS INC., Osaka (JP)

(72) Inventors: Masami Tsujihiro, Osaka (JP); Yoshio Ozawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 17 days.

(21) Appl. No.: 14/062,735

(22) Filed: Oct. 24, 2013

(65) Prior Publication Data

US 2014/0120466 A1 May 1, 2014

(30) Foreign Application Priority Data

Oct. 30, 2012 (JP) ..... 2012-239167

(51) Int. Cl.
*G03G 9/08* (2006.01)
*G03G 9/113* (2006.01)
*G03G 9/097* (2006.01)

(52) U.S. Cl.
CPC ..... *G03G 9/1135* (2013.01); *G03G 9/09716* (2013.01); *G03G 9/09725* (2013.01); *G03G 9/09741* (2013.01); *G03G 9/09775* (2013.01)

(58) Field of Classification Search
CPC ..... G03G 9/09725; G03G 9/09741; G03G 9/09755; G03G 9/09775
USPC ..... 430/108.7, 108.22
See application file for complete search history.

(56) References Cited

U.S. PATENT DOCUMENTS

| | | | | |
|---|---|---|---|---|
| 6,087,059 | A | 7/2000 | Duggan et al. | |
| 2003/0022087 | A1* | 1/2003 | Tachi et al. | 430/108.7 |
| 2005/0100807 | A1* | 5/2005 | Yamazaki et al. | 430/108.6 |
| 2007/0009823 | A1 | 1/2007 | Skorokhod et al. | |
| 2010/0173240 | A1* | 7/2010 | Sensui | 430/108.2 |

FOREIGN PATENT DOCUMENTS

| | | | |
|---|---|---|---|
| DE | 10218790 | A1 | 1/2003 |
| EP | 1065570 | A1 | 1/2001 |
| JP | S63-155150 | A | 6/1988 |
| JP | H01-295269 | A | 11/1989 |
| JP | 10-039534 | A | 2/1998 |
| JP | 2005-097575 | A | 4/2005 |
| JP | 2006-251267 | A | 9/2006 |
| JP | 2006-251400 | A | 9/2006 |

OTHER PUBLICATIONS

The extended European search report issued by the European Patent Office on Jan. 27, 2014, which corresponds to EP13190011.0-1303 and is related to U.S. Appl. No. 14/062,735.

An Office Action; "Notice of Reasons for Rejection," issued by the Japanese Patent Office on Mar. 3, 2015, which corresponds to Japanese Patent Application No. 2012-239167 and is related to U.S. Appl. No. 14/062,735.

* cited by examiner

*Primary Examiner* — Mark A Chapman
(74) *Attorney, Agent, or Firm* — Studebaker & Brackett PC

(57) ABSTRACT

An electrostatic latent image developing toner includes toner base particles including a binder resin and an external additive attached to surfaces of the toner base particles. The external additive contains silica covered with a coating layer containing a nitrogen containing resin.

6 Claims, No Drawings

ELECTROSTATIC LATENT IMAGE DEVELOPING TONER

INCORPORATION BY REFERENCE

The present application claims priority under 35 U.S.C. §119 to Japanese Patent Application No. 2012-239167, filed Oct. 30, 2012. The contents of this application are incorporated herein by reference in their entirety.

BACKGROUND

The present disclosure relates to electrostatic latent image developing toner.

According to electrophotography, in general, the surface of a photosensitive drum is electrostatically charged and is then subjected to exposure according to a to-be-formed image, thereby forming an electrostatic latent image on the surface of the photosensitive drum. Development of the formed electrostatic latent image with toner results in formation of a toner image. Further, the formed toner image is transferred to a recording medium, thereby obtaining a high quality image. Usually, toner particles (toner base particles) with an average particle diameter of 5 μm or larger and 10 μm or smaller are used as the tone used for formation of the toner image. The toner particles are obtainable in a manner that components, such as colorant, a charge control agent, a releasing agent, a magnetic material, etc. are mixed with a binder resin, such as thermoplastic resin, and the mixture is kneaded, crushed, and classified.

Further, in order to provide fluidity to the toner, to maintain the toner in an appropriate charge state, and to increase toner cleaning performance, inorganic fine powder of silica, titanium oxide, or the like is generally added as an external additive to the toner base particles.

The inorganic fine powder of silica, titanium oxide, and the like tends to be negatively charged in general. In particular, silica displays strong negative charge characteristics. In view of this, in the case using the inorganic fine powder for the positively charged toner, inorganic fine powder may be used which has a surface into which a positively charged polar group is introduced. As a toner to which such inorganic fine powder having a positively charged polar group is externally added, there is known a toner that contains silica treated with a silane coupling agent containing an amino group as an external additive.

Further, there is known a toner in which silica is externally added to the surfaces of toner base particles formed of a binder resin and colorant, wherein the silica includes silica A of which surface is treated with aminosilane and silica B of which surface is treated with a hydrophobizing agent.

SUMMARY

An electrostatic latent image developing toner according to the present disclosure includes toner base particles including a binder resin and an external additive attached to surfaces of the toner base particles. The external additive contains silica covered with a coating layer containing a nitrogen containing resin.

DETAILED DESCRIPTION

Embodiments of the present disclosure will be described below in detail. However, the present disclosure is not limited to the following embodiments and can be reduced to practice with appropriate modification within the scope of the present disclosure. It is noted that description of parts about which description is duplicate may be omitted appropriately. However, this should not be taken to limit the disclosure.

[Electrostatic Latent Image Developing Toner]

An electrostatic latent image developing toner (which may be referred to as merely toner) according to the present disclosure is a toner in which an external additive is attached to the surfaces of toner base particles containing at least a binder resin. The toner base particles may include a component, such as colorant, a charge control agent, a releasing agent, magnetic powder, etc. as necessary in addition to the binder resin. Further, the external additive contains silica covered with a coating layer containing a nitrogen containing resin. The electrostatic latent image developing toner according to the present disclosure can be mixed with a carrier so as to be used as a two-component developer, if desired. Description will be made below in this order about the binder resin, the colorant, the charge control agent, the releasing agent, the magnetic powder, the external additive, a method for producing the toner base particles, a method for external addition, and the carrier used in the two-component developer.

[Binder Resin]

The binder resin contained in the toner is not particularly limited as long as it is a resin conventionally used as a binder resin for toners. The binder resin may be a thermoplastic resin, for example. Specific examples of the binder resin include styrene-based resin, acrylic resin, styrene-acrylic resin, polyethylene-based resin, polypropylene-based resin, vinyl chloride-based resin, polyester resin, polyamide resin, polyurethane resin, polyvinyl alcohol-based resin, vinyl ether-based resin, N-vinyl based resin, and styrene-butadiene based resin. Among these types of resin, styrene-acrylic resin and polyester resin are preferable in view of dispensability of the colorant in the toner, charge characteristics of the toner, and fixability of the toner to paper.

Styrene acrylic resin is a copolymer of styrene-based monomers and acrylic monomers. Specific examples of the styrene-based monomer include styrene, α-methylstyrene, vinyltoluene, α-chlorostyrene, o-chlorostyrene, m-chlorostyrene, p-chlorostyrene, and p-ethylstyrene. The acrylic monomer may be a (meth)acrylate alkyl ester, for example. Specific examples of the (meth)acrylate alkyl ester include methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

Polyester resin can be used which is obtained by condensation polymerization or co-condensation polymerization of an alcohol component and a carboxylic acid component. Examples of the component used in synthesis of polyester resin include the following divalent and trivalent or higher-valent alcohol components and divalent and trivalent or higher-valent carboxylic acid components.

Specific examples of the divalent and trivalent or higher-valent alcohol components include: diols (e.g., ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol); bisphenols (e.g., bisphenol A, hydrogenated bisphenol A, polyoxyethylene-modified bisphenol A, and polyoxypropylene-modified bisphenol A); and trivalent or higher-valent alcohols (e.g., sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene).

Specific examples of the divalent and trivalent or higher-valent carboxylic acid components include: divalent carboxylic acids (e.g., alkylsuccinic acid or alkenylsuccinic acid (more specifically, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, and malonic acid, n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, and isododecenylsuccinic acid); and trivalent or higher-valent carboxylic acids (e.g., 1,2,4-benzene tricarboxylic acid (trimellitic acid), 1,2,5-benzene tricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid). Any of these divalent and trivalent or higher-valent carboxylic acid components may be used as a derivative for ester formation, such as acid halide, acid anhydride, lower alkyl ester, etc. The term, "lower alkyl" herein means an alkyl group with one to six carbon atoms.

Where the binder resin is a polyester resin, the softening point of the polyester resin is preferably 80° C. or higher and 150° C. or lower, and more preferably 90° C. or higher and 140° C. or lower.

Although it is preferable to use a thermoplastic resin as the binder resin, since the toner including a thermoplastic resin can be excellently fix the toner to paper, a crosslinking agent and thermosetting resin may be added to the thermoplastic resin besides sole use of thermoplastic resin. Introduction of a partially crosslinked structure in the binder resin can improve characteristics, such as storage stability of the toner, a shape retention characteristic, durability, etc. without degradation of fixability of the toner to paper.

As the thermosetting resin, which can be used in combination with the thermoplastic resin, epoxy resin and cyanate-based resin are preferable. Examples of suitable thermosetting resin include bisphenol A type epoxy resin, hydrogenated bisphenol A type epoxy resin, novolac-type epoxy resin, poly (alkylene ether)-type epoxy resin, cyclic aliphatic-type epoxy resin, and cyanate resin. Two or more types of the thermosetting resin may be used in combination.

The glass transition point (Tg) of the binder resin is preferably 50° C. or higher and 65° C. or lower, and more preferably 50° C. or higher and 60° C. or lower. Where the glass transition point of the binder resin is too low, toner may be fused in the interior of the developing section of the image forming apparatus, or the storage stability may be impaired, which may result in partial fusion of the toner in transport of the toner container and in storage of the toner container in a storehouse. By contrast, a too high glass transition point may reduce the strength of the binder resin to tend to cause the toner to adhere to the latent image bearing member (image carrier: photoreceptor). Where the glass transition point is too high, the toner may tend to be difficult to favorably fix to paper at low temperature.

It is noted that the glass transition point of the binder resin can be obtained from the point of variation of the specific heat of the binder resin with the use of a differential scanning calorimeter (DSC). More specifically, the glass transition point of the binder resin can be obtained by measuring an endothermic curve of the binder resin with the use of a differential scanning calorimeter, DSC-6200 (by Seiko Instruments Inc.) as a measuring device. A sample of 10 mg is put into an aluminum pan. An empty aluminum pan is used as a reference. The glass transition point of the binder resin can be obtained using an endothermic curve of the binder resin obtained by measurement at the normal temperature and humidity in a measurement temperature range of 25° C. or higher and 200° C. or lower at a heating rate of 10° C./min.

[Colorant]

The toner base particles of the toner according to the present disclosure may contain colorant. The colorant may be mixed with the binder resin. As the colorant contained in the binder resin, known pigment or dye may be used according to the color of the toner particles. Specific examples of suitable colorant contained in the binder resin may be the following colorant.

Examples of black colorant include carbon black. Further, as the black colorant, colorant toned black with the use of colorant, such as yellow colorant, magenta colorant, and cyan colorant, may be exploited, which will be described later.

Where the toner is a color toner, colorant, such as yellow colorant, magenta colorant, and cyan colorant may be used as colorant blended with the binder resin.

Examples of the yellow colorant include colorant of condensed azo compounds, isoindolinone compounds, anthraquinone compounds, azo metal complexes, methine compounds, allylamide compounds, etc. Specific examples may be: C.I. pigment yellow 3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194; naphthol yellow S; hansa yellow G; and C.I. vat yellow.

Examples of the magenta colorant include colorant of condensed azo compounds, diketopyrrolopyrrole compounds, anthraquinone compounds, quinacridone compounds, basic dye lake compounds, naphthol compounds, benzimidazolone compounds, thioindigo compounds, perylene compounds, etc. Specific examples may be C.I. pigment red 2, 3, 5, 6, 7, 19, 23, 48:2, 48:3, 48:4, 57:1, 81:1, 122, 144, 146, 150, 166, 169, 177, 184, 185, 202, 206, 220, 221, and 254.

Examples of the cyan colorant include colorant of copper phthalocyanine compounds, copper phthalocyanine derivatives, anthraquinone compounds, basic dye lake compounds, etc. Specific examples may be: C.I. pigment blue 1, 7, 15, 15:1, 15:2, 15:3, 15:4, 60, 62, 66; phthalocyanine blue; C.I. vat blue; and C.I. acid blue.

The amount of the colorant blended with the binder resin is not particularly limited within the range not adversely affecting the present disclosure. Specifically, the amount of use of the colorant is preferably 1 part by mass or more and 20 parts by mass or less, and more preferably 3 parts by mass or more and 10 parts by mass or less relative to 100 parts by mass of the binder resin.

[Charge Control Agent]

The toner base particles of the toner according to the present disclosure may contain a charge control agent. The charge control agent may be mixed with the binder resin. The charge control agent is used for the purpose of obtaining a toner excellent in durability and stability by improving the characteristics, such as stability of the charge level of the toner, and charge rising property serving as an index as to whether or not the toner is capable of being charged up to a desired charge level within a short period of time. The toner according to the present disclosure includes an external additive having a coating layer containing the nitrogen containing resin. Therefore, the charge polarity of the toner is positive.

For this reason, the toner according to the present disclosure may contain a positively chargeable charge control agent.

The type of the charge control agent is not particularly limited within the scope not adversely affecting the present disclosure and can be appropriately selected from charge control agents conventionally used for toners. Specific examples of the positively chargeable charge control agent include pyridazine, pyrimidine, pyrazine, ortho-oxazine, meta-oxazine, para-oxazine, azine compounds (e.g., ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline); direct dyes formed of an azine compound (e.g., azine fast red FC, azine fast red 12BK, azine violet BO, azine brown 3G, azine light brown GR, azine dark green BH/C, azine deep black EW, and azine deep black 3RL); nigrosine compounds (e.g., nigrosine, nigrosine salts, and nigrosine derivatives); acid dyes formed of a nigrosine compound (e.g., nigrosine BK, nigrosine NB, and nigrosine Z); metal salts of a naphthenic acid or a higher fatty acid; alkoxylated amine; alkylamide; and quaternary ammonium salts (e.g., benzylmethylhexyldecylammonium, and decyltrimethylammonium chloride). Two or more of these positively chargeable charge control agents may be used in combination.

Resin with any of quarternary ammonium salt, carboxylate salt, and a carboxyl group as a functional group may be used also as the positively chargeable charge control agent. More specific examples include styrene-based resin with quarternary ammonium salt, acrylic resin with quarternary ammonium salt, styrene-acrylic resin with quarternary ammonium salt, polyester resin with quarternary ammonium salt, styrene-based resin with carboxylate salt, acrylic resin with carboxylate salt, styrene-acrylic resin with carboxylate salt, polyester resin with carboxylate salt, styrene-based resin with a carboxyl group, acrylic resin with a carboxyl group, styrene-acrylic resin with a carboxyl group, and polyester resin with a carboxyl group. The molecular weight of these types of resin is not particularly limited within a range not adversely affecting the present disclosure. The resin may be an oligomer or a polymer.

Among the resin which can be used as the positively chargeable charge control agent, styrene-acrylic resin with a quarternary ammonium salt as a functional group is preferable in view of easy adjustment of the charge amount to a value in a desired range. For example, alkyl(meth)acrylate ester is preferable as an acrylic comonomer for copolymerization with a styrene unit in preparing the styrene-acrylic resin with quarternary ammonium salt as a functional group. Specific examples thereof include methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

Further, as the quarternary ammonium salt, a unit is used which is derivatized through quaternization from a dialkylaminoalkyl(meth)acrylate, a dialkyl(meth)acrylamide, or a dialkylaminoalkyl(meth)acrylamide. Specific examples of the dialkylaminoalkyl(meth)acrylate include dimethylaminoethyl(meth)acrylate, diethylaminoethyl(meth)acrylate, dipropylaminoethyl(meth)acrylate, and dibutylaminoethyl (meth)acrylate. One specific examples of the dialkyl(meth) acrylamide includes dimethylmethacrylamide. One specific example of the dialkylaminoalkyl(meth)acrylamide includes dimethylaminopropylmethacrylamide. Further, a hydroxy group containing polymerizable monomer (e.g., hydroxyethyl(meth)acrylate, hydroxypropyl(meth)acrylate, 2-hydroxybutyl(meth)acrylate, and N-methylol(meth)acrylamide) may be used in combination in polymerization.

The amount of use of the positively chargeable charge control agent is not particularly limited within the range not adversely affecting the present disclosure. Typically, the amount of use of the positively chargeable charge control agent is preferably 0.5 parts by mass or more and 20.0 parts by mass or less, and more preferably 1.0 part by mass or more and 15.0 parts by mass or less relative to 100 parts by mass of the total amount of the toner. A too small amount of use of the charge control agent may make it difficult to stably charge the toner to a desired polarity. Accordingly, the image density of a formed image may be lower than a desired value and may be difficult to be maintained over a long period of time. Further, in this case, the charge control agent may be difficult to uniformly disperse in the binder resin. This may tend to cause fogging in a formed image and contamination of the latent image baring member with the toner. Too large amount of use of the charge control agent may make resistance to environment worse. This tends to cause image failure in a formed image and to cause contamination of the latent image bearing member with the toner, which are caused due to charge deficiency in high temperature and high humidity.

[Releasing Agent]

The toner base particles of the toner in the present disclosure may contain a releasing agent as necessary. The releasing agent is generally used for the purpose of improving fixability of the toner and offset resistance. The type of the releasing agent is not particularly limited as long as it is used as a conventional releasing agent for toners.

Examples of a suitable releasing agent include: aliphatic hydrocarbon based waxes, (e.g., low molecular weight polyethylene, low molecular weight polypropylene, polyolefin copolymers, polyolefin wax, microcrystalline waxes, paraffin wax, and Fischer-Tropsch wax); oxides of an aliphatic hydrocarbon based wax (e.g., polyethylene oxide wax and block copolymers of polyethylene oxide wax); vegetable waxes (e.g., candelilla wax, carnauba wax, Japan wax, jojoba wax, and rice wax); animal waxes (beeswax, lanolin, and spermaceti); mineral waxes (ozokerite, ceresin, and petrolatum); waxes of which main component is a fatty acid ester (e.g., montanoic acid ester wax and castor wax); and waxes in which a fatty acid ester is partially or entirely deoxidized, such as deoxidized carnauba wax.

Examples of the releasing agent which can be used suitably further include: saturated linear fatty acids (e.g., palmitic acid, stearic acid, montanoic acid, and long chain alkylcarboxylic acids with a further long chain alkyl group); unsaturated fatty acids (e.g., brassidic acid, eleostearic acid, and parinaric acid); saturated alcohols (e.g., stearyl alcohol, eicosyl alcohol, behenyl alcohol, carnaubyl alcohol, ceryl alcohol, myricyl alcohol, and long chain ackyl alcohol with a further long chain alkyl group); polyols, such as sorbitol; fatty acid amides (e.g., linoleamide, oleamide, and lauramide); saturated fatty acid bisamides (e.g., methylene bisstearamide, ethylene biscapramide, ethylene bislauramide, and hexamethylene bisstearamide); unsaturated fatty acid amides (e.g., ethylene bisoleamide, hexamethylene bisoleamide, N,N'-dioleyladipamide, and N,N'-dioleylsebacamide); aromatic bisamides (e.g., m-xylene bisstearamide, and N,N'-distearylisophthalamide); fatty acid metal salts (e.g., calcium stearate, calcium laurate, zinc stearate, and magnesium stearate); wax in which a vinyl-based monomer (e.g., styrene and acrylic acid) is grafted to aliphatic hydrocarbon based wax; partially esterified compounds of a fatty acid and a polyol (e.g., behenic acid monoglyceride); and methylester compounds with a hydroxyl group obtained by hydrogenation of vegetable oil.

The amount of use of the releasing agent is not particularly limited within a range not adversely affecting the present disclosure. A specific range of the amount of use of the releasing agent is preferably 1 part by mass or more and 30 parts by mass or less relative to 100 parts by mass of the binder resin. In order to produce the toner by crushing, which will be described later, the amount of use of the mold releasing agent is preferably 1 part by mass or more and 8 parts by mass or less, and more preferably 2 parts by mass or more and 5 parts by mass or less relative to 100 parts by mass of the binder resin. Where the amount of use of the releasing agent is too small, desired advantages may not be obtained in reduction in offset and image smearing in an formed image. By contrast, where the amount of use of the releasing agent is too large, toner fusion may be caused to reduce the storage stability of the toner.

[Magnetic Powder]

The toner base particles of the toner according to the present disclosure may contain magnetic powder as necessary. The types of the magnetic powder are not particularly limited within the scope not adversely affecting the present disclosure. Examples of suitable magnetic powder include irons (e.g., ferrite and magnetite); ferromagnetic metals (e.g., cobalt and nickel); alloys containing an iron and/or a ferromagnetic metal; compounds containing an iron and/or a ferromagnetic metal; ferromagnetic alloys subjected to ferromagnetization, such as thermal treatment; and chromium dioxides.

The particle diameter of the magnetic powder is not particularly limited within the range not adversely affecting the present disclosure. A specific particle diameter of the magnetic powder is preferably 0.1 μm or larger and 1.0 μm or smaller, and more preferably 0.1 μm or larger and 0.5 μm or smaller. The use of the magnetic powder with a particle diameter in such a range can easily achieve uniform dispersion of the magnetic powder in the binder resin.

The amount of use of the magnetic powder is not particularly limited within a range not adversely affecting the present disclosure. In the case using the toner as one-component developer, a specific amount of use of the magnetic powder is preferably 35 parts by mass or more and 60 parts by mass or less, and more preferably 40 parts by mass or more and 60 parts by mass or less relative to 100 parts by mass of the total amount of the toner. Where the amount of use of the magnetic powder is too large, it is difficult to maintain a desired image density in image formation for a long period of time, and fixability may reduce excessively. Where the amount of use of the magnetic powder is too small, fogging may tend to be caused in a formed image to cause difficulty in maintaining a desired image density. Further, in the case using the toner as two-component developer, the amount of use of the magnetic powder is preferably 20 mass % or lower, and more preferably 15 mass % or lower relative to 100 parts by mass of the total amount of the toner.

[External Additive]

The toner according to the present disclosure includes the toner base particles having surfaces to which the external additive is attached. The external additive contains silica covered with the coating layer containing the nitrogen containing resin. The silica used for the external additive is not particularly limited within the scope not adversely affecting the present disclosure and is preferably hydrophilic silica, and more preferably hydrophilic fumed silica. It is noted that the term, "nitrogen containing resin" in the claims and the specification of the present application means a resin that contains nitrogen atoms in its chemical structure.

[Coating Layer]

The coating layer covering the silica contains the nitrogen containing resin. The toner according to the present disclosure uses the silica covered with the coating layer containing the nitrogen containing resin as an external additive. This can provide excellent fluidity. Further, the toner according to the present disclosure can be charged to a desired charge amount in image formation after the toner is preserved over a long period of time in a normal temperature and normal humidity environment or a high temperature and high humidity environment. Also, in image formation using the toner for a long period of time in a normal temperature and normal humidity environment or a high temperature and high humidity environment, the toner can be charged to a desired charge amount, and toner scattering caused due to reversely charged toner can be reduced.

The nitrogen containing resin contained in the coating layer is not particularly limited within the scope not adversely affecting the present disclosure. Examples of the nitrogen containing resin include one type and a mixture of any types of amino resin, melamine resin, urea resin, polyamide resin, polyimide resin, polyamidimide resin, aniline resin, guanamine resin, polyurethane resin, and polyacrylonitrile resin. Among of them, the nitrogen containing resin is preferably selected from melamine resin and urea resin in view of firm adhesion of the coating layer to the surface of the silica.

An intermediate of melamine resin and urea resin has a methylol group, which is generated by adding formaldehyde to melamine or urea. By contrast, silica generally has a silanol group on its surface. For this reason, when the coating layer covering the silica is formed using the following melamine resin or urea resin producing method, covalent bond is formed between the silica with a silanol group and the resin selected from melamine resin and urea resin, which forms the coating layer, by a reaction between the silanol group exposed on the surface of the silica and a methylol group that the intermediate of the material of the coating layer has. Accordingly, when coating the silica with the melamine resin or the urea resin, the coating layer is bonded to the silica firmly.

<Method for Forming Coating Layer>

A method for forming the coating layer is not particularly limited as long as a material for the coating layer is used, and the silica particles are favorably covered with the coating layer containing the nitrogen containing resin. Where the nitrogen containing resin is soluble in an organic solvent, the silica can be covered with the coating layer containing the nitrogen containing resin by covering the silica with an organic solvent solution of the nitrogen containing resin, followed by removal of the organic solvent (solution coating method). Alternatively, where a monomer or a precursor of the nitrogen containing resin is soluble in a solvent, the silica covered with the coating layer containing the nitrogen containing resin can be obtained by synthesizing the nitrogen containing resin by causing reaction of the monomer or the precursor in the solvent in which the silica disperses (reaction method). Of these coating layer forming methods, the reaction method is more preferable in view of the fact that it is easy to firmly fix the coating layer to the surface of the silica.

In the reaction method, the silica particles are dispersed in the solvent. However the method for dispersing the silica particles in the solvent used for forming the coating layer is not particularly limited as long as the silica particles can be highly dispersed in the solvent used for forming the coating layer. In order to obtain the dispersion solution of the silica particles, it is preferable to use a device capable of strongly stiffing the dispersion solution, such as HIVIS MIX® (by PRIMIX Corporation), for example, in view of the fact that it is easy to highly disperse the silica particles.

Where the resin selected from melamine resin and urea resin is used as the nitrogen containing resin, an example of the melamine resin includes a polycondensate of melamine with formaldehyde. Also, an example of urea resin includes a polycondensate of urea with formaldehyde. A producing method of melamine resin is as follows. First, an addition reaction of melamine with formaldehyde is caused to obtain a precursor (methylolated melamine) of the melamine resin. Then, the melamine resin is obtained through condensation of the methylolated melamine, that is, a cross linking reaction of melamine in which amino groups that melamine has are bonded together through a methylene group. The urea resin can be obtained by the same method as the melamine resin producing method, except that urea is used in lieu of melamine.

It is noted that in forming the coating layer containing the melamine resin or the urea resin, the dispersion solution of the silica particles is preferably adjusted to have a pH of 2 or higher and 6 or lower by an acid substance before forming the coating layer. Adjustment of pH of the dispersion solution to acidity can accelerate formation of the coating layer.

The temperature in forming the coating layer containing the melamine resin or the urea resin is not particularly limited, but is preferably 60° C. or higher and 100° C. or lower. Formation of the coating layer at a temperature in such a range can allow formation of the coating layer that covers the surfaces of the silica particles to progress favorably.

After a reaction of all materials for forming the coating layer in the dispersion solution is caused by heating, the dispersion solution is cooled down to the normal temperature. Thus, the dispersion solution can be obtained in which the silica covered with the coating layer is dispersed as the external additive particles. Then, after one or more steps as necessary selected from a cleaning step of cleaning the external additive particles, a drying step of drying the external additive particles, and a crushing step of crushing coarse particles of the external additive for reduction in particle size, the external additive particles are collected from the dispersion solution of the external additive particles. The cleaning step, the drying step, and the crushing step will be described below.

<Cleaning Step>

The external additive particles may be cleaned with water as necessary. The method for cleaning the external additive particles is not particularly limited. Examples of a suitable method for cleaning the external additive particles include a method, in which the external additive particles is collected as a wet cake from the dispersion solution including the external additive particles by solid-liquid separation, followed by cleaning the obtained wet cake with water, and a method, in which the external additive particles in the dispersion solution including the external additive particles are precipitated, followed by substitution of supernatant liquid with water, and the external additive particles are then dispersed again in the water.

<Drying Step>

The external additive particles may be dried as necessary. The method for drying the external additive particles is not particularly limited. One example of a suitable drying method may be a method using a dryer, such as a spray dryer, a fluidized bed dryer, a vacuum freeze dryer, or a vacuum dryer.

<Crushing Step>

The external additive particles collected by any of the aforementioned method are collected in the form of coarse powder (coarse powder of the external additive), which is agglomerate of the silica covered with the coating layer. For this reason, the external additive particles (coarse powder of the external additive) produced by the above method may be crushed as necessary. One example of a suitable crushing method may be a method using a crusher, such as a continuous surface-modifying apparatus, a pneumatic crusher, or a mechanical crusher.

The content of the nitrogen containing resin in the coating layer is not particularly limited within the range not adversely affecting the present disclosure and is preferably 80 mass % or higher, more preferably 90 mass % or higher, still more preferably 95 mass % or higher, and the most preferably 100 mass %. Examples of resin which the coating layer may contain other than the nitrogen containing resin include resin, such as (meth)acrylic polymers, styrene-based polymers, styrene-(meth)acrylic copolymers, olefin-based polymers (resin such as polyethylene, chlorinated polyethylene, and polypropylene), polyvinyl chloride, polyvinyl acetate, polycarbonate, cellulose resin, polyester resin, unsaturated polyester resin, epoxy resin, silicone resin, phenolic resin, xylene resin, diallyl phthalate resin, polyacetal resin, aromatic polyether ketone-based resin, and fluororesin.

The mass of the coating layer is not particularly limited within the range not adversely affecting the present disclosure. Specifically, the mass thereof is preferably 50 parts by mass or more and 1500 parts by mass or less, and more preferably 100 parts by mass or more and 1000 parts by mass or less relative to 100 parts by mass of the silica.

[Method for Producing Toner Base Particles]

The method for producing the toner base particles is not particularly limited as long as the toner base particles, which contain any of the aforementioned components in the binder resin as necessary, can be produced. Examples of a suitable method include a crushing method and an aggregation method. In the crushing method, the toner base particles are obtained by mixing the binder resin with any optional component, such as the colorant, the charge control agent, and the releasing agent, melting and kneading the obtained mixture by a melt-kneader, such as an extruder with a single shaft or two shafts, and then crushing and classifying the melt-kneaded substance. In the aggregation method, after aggregated particles are obtained by aggregating particulates of components contained in the toner, such as the binder resin, the releasing agent, and the colorant in an aqueous medium, the aggregated particles are heated to coalesce the components contained in the aggregated particles, thereby obtaining the toner base particles. The average particle diameter of the toner base particles obtained by either of the above methods is not particularly limited within the range not adversely affecting the present disclosure and preferably 5 μm or larger and 10 μm or smaller in general.

[Method for External Addition]

The toner according to the present disclosure is produced by attaching the external additive to the surfaces of the toner base particles. The method for external addition of the external additive to the toner base particles is not particularly limited and may be appropriately selected from conventionally known methods. Specifically, the external addition is performed in a manner that the conditions for the external addition are adjusted so that the particles of the external additive are not enbeded in the toner base particles, and the toner base particles are mixed with the external additive by a mixer, such as a Henschel mixer or a Nauta Mixer.

The amount of use of the external additive is not particularly limited within a range not adversely affecting the present disclosure. Typically, the amount of use of the external additive is preferably 1 part by mass or more and 10 parts by mass or less, and more preferably 1.5 parts by mass or more and 5 parts by mass or less relative to 100 parts by mass of the toner base particles.

[Carrier]

The electrostatic latent image developing toner according to the present disclosure may be used as two-component developer by mixing it with a desired carrier. In preparing the two-component developer, it is preferable to use a magnetic carrier as the carrier.

A suitable carrier, used in the case where the electrostatic latent image developing toner of the present disclosure is used as the two-component developer, may be a carrier including carrier core material whose surface is covered by using resin. Specific examples of the carrier core material include particles of a metal (e.g., iron, iron subjected to oxidation, reduced iron, magnetite, copper, silicon steel, ferrite, nickel, and cobalt), particles of an alloy of any of these materials and a metal, such as manganese, zinc, aluminum, particles of an iron alloy, such as iron-nickel alloy, iron-cobalt alloy, particles of a ceramics (e.g., titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate), particles of a high dielectric (e.g., ammonium dihydrogen phosphate, potassium dihydrogen phosphate, and Rochelle salt), and a resin carrier containing a resin in which any of the above magnetic particles are dispersed.

Specific examples of the resin covering the carrier core material include (meth)acrylic polymers, styrene-based polymers, styrene-(meth)acrylic copolymers, olefin-based polymers (polyethylene, chlorinated polyethylene, and polypropylene), polyvinyl chloride, polyvinyl acetate, polycarbonate, cellulosic resin, polyester resin, unsaturated polyester resin, polyamide resin, polyurethane resin, epoxy resin, silicone resin, fluororesin (polytetrafluoroethylene, polychlorotrifluoroethylene, and polyvinylidene fluoride), phenolic resin, xylene resin, diallyl phthalate resin, polyacetal resin, and amino resin. Two or more types of the above resin may be used in combination.

The particle diameter of the carrier is not particularly limited within the range not adversely affecting the present disclosure and is preferably 20 μm or larger and 120 μm or smaller, and more preferably 25 μm or larger and 80 μm or smaller in measurement using an electron microscope.

Where the electrostatic latent image developing toner of the present disclosure is used as the two-component developer, the content of the toner is preferably 3 mass % or higher and 20 mass % or lower, and more preferably 5 mass % or higher and 15 mass % or lower relative to the mass of the two-component developer. When the content of the toner in the two-component developer is set in such a range, the image density of a formed image can be easily maintained at an appropriate level. Further, toner scattering from the development section can be reduced, which can result in prevention of contamination in the interior of the image forming apparatus with the toner and adherence of the toner to a recording medium, such as transfer paper. It is noted that the method for producing the two-component developer is not limited as long as the toner and the carrier can be mixed together homogenously. A suitable method may be mixing the carrier with the toner with the use of a mixer, such as a ball mill.

The electrostatic latent image developing toner according to the present disclosure as described above can be charged to a desired charge amount in image formation after the toner is preserved over a long period of time in a normal temperature and normal humidity environment or a high temperature and high humidity environment. Also, in image formation using the toner for a long period of time in a normal temperature and normal humidity environment or a high temperature and high humidity environment, the toner can be charged to a desired charge amount, and toner scattering caused due to reversely charged toner can be reduced. Accordingly, the electrostatic latent image developing toner of the present disclosure can be used suitably for various types of image forming apparatuses.

EXAMPLES

The present disclosure will be described further in detail below in the following examples. It is noted that the present disclosure is not limited to the following examples.

Preparation Example 1

[Preparation of Silica A-F]

<Coating Layer Forming Step>

Ion exchange water of 500 ml and the following silica X of 50 g were stirred at the normal temperature for 30 minutes at 30 rpm by a mixer (T. K. HIVIS DISPER MIX Model HM-3D-5 by PRIMIX Corporation), thereby preparing an aqueous medium dispersion solution of the silica. To the obtained aqueous medium dispersion solution of the silica, 0.5N-dilute hydrochloric acid was added, thereby adjusting the pH of the aqueous medium dispersion solution of the silica to 3 or higher and 4 or lower. Next, respective materials for the coating layer of the types and amounts listed in Table 1 were put into the aqueous medium dispersion solution of the silica of which pH was adjusted. Then, each resultant mixture was stirred at the normal temperature for 5 minutes at 30 rpm to be mixed. After the mixing, the respective contents in the mixer were moved to one-litter separable flasks with a thermometer and a stirring impeller.

Silica X: AELOSIL (registered trademark) 200 (by NIPPON AIROSIL CO., LTD., aqueous fumed silica with a specific surface area of 200 $m^2/g$ and a volume average particle diameter ($D_{50}$) of 21 nm)

Using a stirring device in which a stirring impeller (AS ONE Stirring Impeller R-1345 by AS ONE corporation) is mounted to a motor (AS ONE tornado motor, 1-5472-04 by AS ONE corporation), the contents in the flasks were stirred, while the temperature of the content was increased from 35° C. to 70° C. at a rate of 5° C./15 min. Subsequently, the contents in the flasks were stirred at the same temperature for 30 minutes at 90 rpm, thereby forming coating layers on the surfaces of the respective silica particles. Then, the contents in the flasks were cooled to the normal temperature, thereby obtaining dispersion solutions of silica.

It is noted that commercially available materials listed below were used as the materials for the coating layers in Table 1.

Methylol melamine A: NIKAREJIN S-260 (by NIPPON CARBIDE INDUSTRIES CO., INC.)

Methylol melamine B: NIKAREJIN S-176 (by NIPPON CARBIDE INDUSTRIES CO., INC.)

Methylolated urea: MILBEREJIN SU-100 (by Showa Denko K.K.)

<Drying Step>

Using a Büchner funnel, a wet cake of the external additive was collected by filtration from each silica dispersion solution. The silica wet cake was dispersed in an aqueous solution of ethanol at a concentration of 50 mass %, thereby preparing slurry. The obtained slurry was supplied to a continuous surface-modifying apparatus (COATMISER by Freund Corporation) for drying the silica particles in the slurry, thereby obtaining coarse powder of the respective silica. The drying using COATMISER was performed by blowing hot air at a temperature of 45° C. at a flow rate of 2 $m^3$/min.

<Crushing Step>

By a crusher (Jet Mill Model I-2 by Nippon Pneumatic Mfg. Co., Ltd.) using a ceramic flat plate as an impact plate, the obtained silica coarse powder was crushed at a crushing pressure of 0.6 MPa to obtain silica A-F with volume average particle diameters ($D_{50}$) listed in Table 1. It is noted that each volume average particle diameter ($D_{50}$) was calculated as follows. By a transmission electron microscope (TEM: H-7100FA by Hitachi Ltd.), 100 or more silica particles were photographed by at a magnification of 1,000,000×. Then, each equivalent circular diameter of 100 silica particles arbitrarily selected from the obtained TEM photograph was measured by image analysis software (WinROOF by MITANI CORPORATION) to calculate the average value as the volume average particle diameter ($D_{50}$).

TABLE 1

| Silica | A | B | C | D | E | F |
|---|---|---|---|---|---|---|
| Material for coating layer | | | | | | |
| Type | Methyrol melamine A | Methylolated urea | Methylol melamine B | Methylol melamine A | Methylol melamine A | Methylol melamine A |
| Amount of use [g] | 50 | 50 | 50 | 10 | 100 | 500 |
| Particle diameter [nm] | 21 | 21 | 21 | 21 | 21 | 50 |

Preparation Example 2

[Preparation of Silica G]

Toluene (first grade by Wako Pure Chemical Industries, Ltd.) of 500 ml and γ-aminopropyltriethoxysilane of 1 g were put into a mixer (by T. K. HIVIS DISPER MIX Model HM-3D-5 by PRIMIX Corporation) to dissolve γ-aminopropyltriethoxysilane in toluene. Next, the aforementioned silica X of 50 g was added to the toluene solution in the mixer and was stirred at the normal temperature for 30 minutes at 30 rpm for mixing. Then, the content in the mixer was moved to a one-litter separable flask with a thermometer and a stirring impeller.

The content in the flask were stirred using a stirring device in which a stirring impeller (AS ONE Stirring Impeller R-1345 by AS ONE corporation) is mounted to a motor (AS ONE tornado motor, 1-5472-04 by AS ONE corporation), while the temperature of the content was increased from 35° C. to 70° C. at a rate of 5° C./15 min Subsequently, the content in the flask was stirred at the same temperature for 30 minutes at 90 rpm. Then, toluene was evaporated from the content in the flask with the use of a rotary evaporator, thereby obtaining a solid body. The obtained solid body was dried by a vacuum dryer at a set temperature of 50° C. until the weight was not reduced any more. Further, treatment by an electric furnace was performed at 200° C. for 3 hours in nitrogen air flow, thereby obtaining coarse powder of silica G with a surface into which an amino group is introduced. The obtained coarse powder of silica G was crushed at a crushing pressure of 0.6 MPa by a crusher (Jet Mill Model I-2 by Nippon Pneumatic Mfg. Co., Ltd.) with a ceramic flat plate as an impact plate, thereby obtaining silica G with a volume average particle diameter ($D_{50}$) of 23 nm.

Preparation Example 3

[Preparation of Silica H]

To a mixer (T. K. HIVIS DISPER MIX Model HM-3D-5 by PRIMIX Corporation), n-hexane (first grade by Wako Pure Chemical Industries, Ltd.) of 500 ml and amino-modified silicone oil (KF857 by Shin-Etsu Chemical Co., Ltd.) of 0.1 g were put to dissolve the amino-modified silicone oil in the toluene. Then, the aforementioned silica X of 50 g was added to the n-hexane solution in the mixer. Thereafter, the content in the mixer was stirred at the normal temperature for 30 minutes at 30 rpm. After the stirring, the content in the mixer was moved to a one-litter separable flask with a thermometer and a stirring impeller.

Using a stirring device in which a stirring impeller (AS ONE Stirring Impeller R-1345 by AS ONE corporation) is mounted to a motor (AS ONE tornado motor, 1-5472-04 by AS ONE corporation), the content in the flask were stirred, while the temperature of the content was increased from 35° C. to 70° C. at a rate of 5° C./15 min. Then, the content in the flask at a temperature of 70° C. was dried by a vacuum dryer at a set temperature of 70° C. until the weight was not reduced any more. Further, treatment by an electric furnace was performed at 200° C. for 3 hours in nitrogen air flow, thereby obtaining coarse powder of silica H with a surface into which an amino group is introduced. The obtained coarse powder of silica H was crushed at a crushing pressure of 0.6 MPa by a crusher (Jet Mill Model I-2 by Nippon Pneumatic Mfg. Co., Ltd.) with a ceramic flat plate as an impact plate, thereby obtaining silica H with a volume average particle diameter ($D_{50}$) of 25 nm.

Examples 1-6 and Comparative Examples 1-3

[Preparation of Toner]

The toner for a multifunctional peripheral, TASKalfa 5550 by KYOCERA Document Solutions Inc., which was not subjected to external addition, was used as the toner base particles. 100 parts by mass of the toner base particles and 2 parts by mass of silica of the respective types listed in Table 2 or 5 were mixed by 5-litter Henschel mixer (by Mitsui Miike Machinery Co., Ltd.) for 5 minutes to allow the silica to attach to the toner base particles. Thereafter, the respective toners were sieved by a 300 mesh sieve with an aperture of 48 μm, thereby obtaining toners of Examples 1-6, and Comparative Examples 1-3.

<<Evaluation>>

Two-component developers were prepared by the following method using the toners of Examples 1-6 and Comparative Examples 1-3 and the carrier. Evaluation of resistance to environment of the toner and evaluation of durability of the toner in image formation using each two-component developer were performed by the following method using the obtained two-component developers. Each two-component developer prepared in Preparation Example 4 was put into the cyan development section of a multifunctional peripheral (TASKalfa 5550 by KYOCERA Document Solutions Inc.) as an evaluation device. Then, the toner was put into the cyan toner container of the evaluation device. Evaluation results of Examples 1-6 and Comparative Examples 1-3 are indicated in Tables 2-7.

Preparation Example 4

[Preparation of Two-component Developer]

A carrier (carrier for TASKalfa 5550) and 10 mass % of the respective toners relative to the mass of the carrier were mixed by a ball mill for 30 minutes, thereby preparing two-component developers.

<Evaluation of Resistance to Environment>

[Environment of Normal Temperature and Normal Humidity (20° C. and 60% RH)]

330 g of each two-component developer was weighed in a 500-ml polypropylene container and was subjected to a test of resistance to environment of 24-hour standing in a normal temperature and normal humidity (20° C. and 60% RH) environment. Thereafter, the charge amount of the toner of the two-component developer after the test of resistance to environment was measured. For measurement of the charge amount, a QM meter (Model 210HS-1 by TREK, Inc.) was used. The charge amount was evaluated with reference to the following references.

OK: Charge amount of 15.0 μC/g or larger and 40 μC/g or smaller

NG: Charge amount of below 15.0 μC/g or exceeding 40 μC/g

[Environment of High Temperature and High Humidity (28° C. and 80% RH)]

Further, the same evaluation as the evaluation of resistance to environment in the normal temperature and normal humidity (20° C. and 60% RH) environment was performed on newly prepared two-component developers in a high temperature and high humidity (28° C. and 80% RH) environment. The charge amount was evaluated with reference to the following references.

OK: Charge amount is 12.0 μC/g or larger

NG: Charge amount is below 12.0 μC/g

<Evaluation of Durability>

[Environment of Normal Temperature and Normal Humidity (20° C. and 60% RH)]

Using the evaluation device, a 10,000-page durability test and a 100,000-page durability test were performed in the normal temperature and normal humidity (20° C. and 60% RH) environment. In the 10,000-page durability test, an image was formed on 10,000 pages of recording media at a coverage rate of 5%. In the 100,000-page durability test, an image was formed on 100,000 pages of recording medium at a coverage rate of 5%. A sample image for evaluation formed on a recording medium after each durability test was used as to-be-evaluated image. Evaluation was performed of the charge amount of each toner after the respective durability tests, the transfer efficiency during the respective durability tests, and the image density of the to-be-evaluated image.

[Evaluation of Charge Amount of Toner]

The charge amount of the toner of each two-component developer was measured after the respective durability tests. For measurement of the charge amount, a QM meter (Model 210HS-1 by Trek, Inc.) was used. The charge amount was evaluated with reference to the following references.

OK: Charge amount of 12.0 μC/g or larger and 27 μC/g or smaller

NG: Charge amount of below 12.0 μC/g or exceeding 27 μC/g (Evaluation of Transfer Efficiency)

After each durability test, toner falling in the interior of the evaluation device was collected, and its mass was measured. The transfer efficiency was obtained from the mass of the toner consumed during the durability test and the mass of the collected toner by the following equation. Then, the obtained transfer efficiency was evaluated with reference to the following references.

Transfer efficiency(%)=(((amount of consumed toner)−(amount of collected toner))/(amount of consumed toner))×100

OK: Transfer efficiency is 90% or higher

NG: Transfer efficiency is below 90%

(Evaluation of Image Density)

After each durability test, the image density of the image for evaluation formed on each recording medium was measured by SpectroEye (by SAKATA INX ENG. CO., LTD.). The image density was evaluated with reference to the following references.

OK: Image density is 1.2 or higher

NG: Image density is below 1.2

[Environment of High Temperature and High Humidity (28° C. and 80% RH)]

Furthermore, evaluation similar to the durability evaluation in the normal temperature and normal humidity (20° C. and 60% RH) environment was performed with the use of newly prepared two-component developers in an environment changed to high temperature and high humidity (28° C. and 80% RH). A sample image for evaluation formed on a recording medium after each durability test was used as a to-be-evaluated image. Evaluation was performed of the charge amount of each toner after the 10000-page durability test and 100000-page durability test, the transfer efficiency during the respective durability tests, and the image density of each to-be-evaluated image.

[Evaluation of Charge Amount of Toner]

As to the high temperature and high humidity (28° C. and 80% RH) environment, the charge amount of each toner was evaluated with reference to the following references.

OK: Charge amount is 8.0 μC/g or larger

NG: Charge amount is below 8.0 μC/g (Evaluation of Transfer Efficiency)

As to the high temperature and high humidity (28° C. and 80% RH) environment, the transfer efficiency of each toner was evaluated with reference to the following reference.

OK: Transfer efficiency is 70% or higher

NG: Transfer efficiency is below 70%

(Evaluation of Image Density)

As to the high temperature and high humidity (28° C. and 80% RH) environment, the image density of each image for evaluation formed on the recording media was evaluated with reference to the following references.

OK: Image density is 1.1 or higher

NG: Image density is below 1.1

TABLE 2

| Example | 1 | 2 | 3 | 4 | 5 | 6 |
|---|---|---|---|---|---|---|
| External additive | | | | | | |
| Type | A | B | C | D | E | F |
| Material for coating layer | | | | | | |
| Type | Methylol melamine A | Methylolated urea | Methyrol melamine B | Methylol melamine A | Methylol melamine A | Methylol melamine A |
| Evaluation of resistance to environment | | | | | | |
| Normal temperature and normal humidity (20° C. & 60% RH) | | | | | | |
| Charge amount [μC/g] | 32.3 | 34.3 | 28.4 | 23.8 | 33.4 | 20.3 |
| Evaluation | OK | OK | OK | OK | OK | OK |
| High temperature and high humidity (28° C. & 80% RH) | | | | | | |
| Charge amount [μC/g] | 30.3 | 24.4 | 23.2 | 14.2 | 30.2 | 17.3 |
| Evaluation | OK | OK | OK | OK | OK | OK |

TABLE 3

| Example | 1 | 2 | 3 | 4 | 5 | 6 |
|---|---|---|---|---|---|---|
| External additive | | | | | | |
| Type | A | B | C | D | E | F |
| Material for coating layer | | | | | | |
| Type | Methylol melamine A | Methylolated urea | Methylol melamine B | Methylol melamine A | Methylol melamine A | Methylol melamine A |
| Evaluation of durability in normal temperature and normal humidity environment (20° C. & 60% RH) After 10,000-page durability test | | | | | | |
| Charge amount [μC/g] | 22.3 | 26.5 | 18.6 | 16.7 | 25.3 | 14.5 |
| Evaluation | OK | OK | OK | OK | OK | OK |
| Transfer efficiency [%] | 96 | 95 | 93 | 92 | 96 | 93 |
| Evaluation | OK | OK | OK | OK | OK | OK |
| Image density | 1.48 | 1.44 | 1.45 | 1.40 | 1.48 | 1.40 |
| Evaluation | OK | OK | OK | OK | OK | OK |
| After 100,000-page durability test | | | | | | |
| Charge amount [μC/g] | 18.4 | 16.3 | 15.3 | 12.2 | 18.1 | 13.2 |
| Evaluation | OK | OK | OK | OK | OK | OK |
| Transfer efficiency [%] | 96 | 92 | 91 | 90 | 94 | 90 |
| Evaluation | OK | OK | OK | OK | OK | OK |
| Image density | 1.46 | 1.42 | 1.42 | 1.37 | 1.44 | 1.32 |
| Evaluation | OK | OK | OK | OK | OK | OK |

TABLE 4

| Example | 1 | 2 | 3 | 4 | 5 | 6 |
|---|---|---|---|---|---|---|
| External additive | | | | | | |
| Type | A | B | C | D | E | F |
| Material for coating layer | | | | | | |
| Type | Methylol melamine A | Methylolated urea | Methylol melamine B | Methylol melamine A | Methylol melamine A | Methylol melamine A |
| Evaluation of durability in normal temperature and normal humidity environment (28° C. & 80% RH) | | | | | | |
| After 10,000-page durability test | | | | | | |
| Charge amount [μC/g] | 15.3 | 14.2 | 12.2 | 10.2 | 14.2 | 9.8 |
| Evaluation | OK | OK | OK | OK | OK | OK |
| Transfer efficiency [%] | 85 | 83 | 75 | 75 | 83 | 77 |
| Evaluation | OK | OK | OK | OK | OK | OK |
| Image density | 1.42 | 1.32 | 1.33 | 1.14 | 1.40 | 1.32 |
| Evaluation | OK | OK | OK | OK | OK | OK |
| After 100,000-page durability test | | | | | | |
| Charge amount [μC/g] | 10.0 | 9.3 | 8.5 | 8.2 | 12.3 | 9.3 |
| Evaluation | OK | OK | OK | OK | OK | OK |
| Transfer efficiency [%] | 78 | 72 | 73 | 70 | 82 | 72 |
| Evaluation | OK | OK | OK | OK | OK | OK |
| Image density | 1.23 | 1.18 | 1.20 | 1.15 | 1.28 | 1.24 |
| Evaluation | OK | OK | OK | OK | OK | OK |

TABLE 5

| | Comparative Example | | |
|---|---|---|---|
| | 1 | 2 | 3 |
| External additive | | | |
| Type | X | G | H |
| Surface preparation agent | | | |
| Type | — | γ-aminopropyl-triethoxysilan | Amino-modified silicone oil |
| Evaluation of resistance to environment | | | |
| Normal temperature and normal humidity (20° C. and 60% RH) | | | |
| Charge amount [μC/g] | 13.2 | 38.6 | 19.4 |
| Evaluation | NG | OK | OK |
| High temperature and high humidity (28° C. and 80% RH) | | | |
| Charge amount [μC/g] | 4.2 | 18.2 | 9.3 |
| Evaluation | NG | OK | NG |

TABLE 6

| | Comparative Example | | |
|---|---|---|---|
| | 1 | 2 | 3 |
| External additive | | | |
| Type | X | G | H |
| Surface preparation agent | | | |
| Type | — | γ-aminopropyl-triethoxysilane | Amino-modified silicone oil |
| Evaluation of durability in normal temperature and normal humidity environment (20° C. and 60% RH) | | | |
| After 10,000-page durability test | | | |
| Charge amount [μC/g] | 12.0 | 32.5 | 18.2 |
| Evaluation | OK | OK | OK |
| Transfer efficiency [%] | 80 | 96 | 92 |
| Evaluation | OK | OK | OK |
| Image density | 1.30 | 1.46 | 1.33 |
| Evaluation | OK | OK | OK |
| After 100,000-page durability test | | | |
| Charge amount [μC/g] | 10.0 | 15.3 | 13.2 |
| Evaluation | NG | OK | OK |
| Transfer efficiency [%] | 76 | 92 | 82 |
| Evaluation | NG | OK | NG |
| Image density | 1.20 | 1.43 | 1.34 |
| Evaluation | OK | OK | OK |

TABLE 7

| | Comparative Example | | |
|---|---|---|---|
| | 1 | 2 | 3 |
| External additive | | | |
| Type | X | G | H |
| Surface preparation agent | | | |
| Type | — | γ-aminopropyl-triethoxysilane | Amino-modified silicone oil |
| Evaluation of durability in high temperature and high humidity environment (28° C. and 80% RH) | | | |
| After 10,000-page durability test | | | |
| Charge amount [μC/g] | 3.2 | 10.4 | 7.3 |
| Evaluation | NG | OK | NG |
| Transfer efficiency [%] | 34 | 65 | 53 |
| Evaluation | NG | NG | NG |
| Image density | 0.53 | 1.32 | 0.77 |
| Evaluation | NG | OK | NG |
| After 100,000-page durability test | | | |
| Charge amount [μC/g] | | | |
| Evaluation | — | — | — |
| Transfer efficiency [%] | — | — | — |
| Evaluation | — | — | — |
| Image density | — | — | — |
| Evaluation | — | — | — |

It is understood from Examples 1-6 that the toner subjected to the external addition with the silica covered with the coating layer containing the nitrogen containing resin as the external additive can be charged to a desired charge amount in image formation after the toner is preserved over a long period of time in the normal temperature and normal humidity environment or the high temperature and high humidity environment. Also, in image formation using the toner, which was subjected to the external addition with the silica covered with the coating layer containing the nitrogen containing resin as the external additive, for a long period of time in the normal temperature and normal humidity environment or the high temperature and high humidity environment, the toner can be charged to a desired charge amount, and toner scattering caused due to reversely charged toner can be reduced.

It is understood from Comparative Example 1 that in the case using the silica not covered with the coating layer containing the nitrogen containing resin as the external additive, the toner is difficult to be charged to a desired charge amount in image formation after the toner is preserved over a long period of time in the normal temperature and normal humidity environment or the high temperature and high humidity environment. Also, the toner is difficult to be charged to a desired charge amount, and toner scattering caused due to reversely charged toner is difficult to be reduced in image formation using the toner for a long period of time in the normal temperature and normal humidity environment or the high temperature and high humidity environment. It is noted that because a large amount of toner falling in the interior of the evaluation device was observed after the 10,000-page durability test in the high temperature and high humidity environment in the durability evaluation on each toner of Comparative Examples 1-3, the 100,000-page durability test was not performed thereon.

It is understood from Comparative Examples 2 and 3 that in the case using the silica subjected to the surface treatment with the positively chargeable surface preparation agent as an external additive rather than the nitrogen containing resin, toner scattering caused due to reversely charged toner is difficult to be reduced in image formation for a long period of time in the high temperature and high humidity environment. Further, it is understood from Comparative Example 3 that in the case using the silica subjected to the surface treatment with the amino-modified silicone oil as the external additive, toner scattering caused due to reversely charged toner is difficult to be reduced in image formation for a long period of time in the normal temperature and normal humidity environment. Also, the toner is difficult to be charged to a desired charge amount, and toner scattering caused due to reversely charged toner is difficult to be reduced in image formation for a long period of time in the high temperature and high humidity environment.

What is claimed is:

1. An electrostatic latent image developing toner, comprising:

toner base particles including a binder resin; and an external additive attached to surfaces of the toner base particles, wherein the external additive contains silica covered with a coating layer containing a nitrogen containing resin having a main chain containing at least one of a nitrogen-carbon bond and a carbon-carbon bond.

2. An electrostatic latent image developing toner according to claim 1, wherein the nitrogen containing resin contains at least one type of resin selected from the group consisting of amino resin, melamine resin, urea resin, polyamide resin, polyimide resin, polyamide-imide resin, aniline resin, guanamine resin, polyurethane resin, and polyacrylonitrile resin.

3. An electrostatic latent image developing toner according to claim 1, wherein the nitrogen containing resin contains at least one type of resin selected from the group consisting of melamine resin and urea resin.

4. An electrostatic latent image developing toner according to claim 1, wherein the toner base particles further include at least one selected from the group consisting of colorant, a charge control agent, a releasing agent, and magnetic powder.

5. An electrostatic latent image developing toner according to claim 1, wherein the nitrogen containing resin includes an organic material.

6. An electrostatic latent image developing toner according to claim 1, wherein the main chain of nitrogen containing resin contains at least the nitrogen-carbon bond.

* * * * *